US008121712B2

(12) United States Patent
Bowman et al.

(10) Patent No.: US 8,121,712 B2
(45) Date of Patent: Feb. 21, 2012

(54) SYSTEM AND METHOD FOR DETERMINING AN OFFENSIVE, DEFENSIVE, AND CUMULATIVE EFFICIENCY OF A SPORTS TEAM

(75) Inventors: Robert A. Bowman, Westport, CT (US); Gregg Klayman, New York, NY (US); Cory Schwartz, Merrick, NY (US)

(73) Assignee: MLB Advanced Media, L.P., New York, NY (US)

( * ) Notice: Subject to any disclaimer, the term of this patent is extended or adjusted under 35 U.S.C. 154(b) by 405 days.

(21) Appl. No.: 10/979,799

(22) Filed: Nov. 3, 2004

(65) Prior Publication Data

US 2006/0095148 A1 May 4, 2006

(51) Int. Cl.

| | |
|---|---|
| ***G06F 19/00*** | (2011.01) |
| ***G06F 17/00*** | (2006.01) |
| ***A63F 9/24*** | (2006.01) |
| ***A63F 13/00*** | (2006.01) |

(52) U.S. Cl. ..... 700/91; 463/3

(58) Field of Classification Search ..... 700/92, 700/90–91; 273/317.6–8, 108.3, 108.31–33, 273/460, 461, 148 R; 463/3

See application file for complete search history.

(56) References Cited

U.S. PATENT DOCUMENTS

| | | | | |
|---|---|---|---|---|
| 5,191,573 | A | 3/1993 | Hair | |
| 5,675,734 | A | 10/1997 | Hair | |
| 5,966,440 | A | 10/1999 | Hair | |
| 6,507,727 | B1 | 1/2003 | Henrick | |
| 6,587,837 | B1 | 7/2003 | Spagna et al. | |
| 2001/0025259 | A1 | 9/2001 | Rouchon | |
| 2002/0023014 | A1 | 2/2002 | Hughes et al. | |
| 2003/0060157 | A1 | 3/2003 | Henrick | |
| 2005/0001837 | A1 * | 1/2005 | Shannon | 345/440 |
| 2005/0227793 | A1 * | 10/2005 | Kerns | 473/451 |

OTHER PUBLICATIONS

Carminati, Mike. "Holey O ZOne, Baseball!" Sep. 21, 2004 Mikes Baseball Rants, http://www.all-baseball.com/mikesbballrants/archives/015588.html.*

Klayman, Gregg, "Introducing the O Zone Factor" Sep. 22, 2004, http://mlb.mlb.com/NASApp/mlb/mlb/news/mlb_news.jsp?ymd=20040921&content_id=865660&vkey=news_mlb&fext=.jsp.*

"What is the MLB.com O Zone Factor" Jul. 18, 2006, http://mlb.mlb.com/NASApp/mlb/stats/ozonefactor.jsp?c_id=mlb.*

"MLB.com Introduces the O Zone Factor" Sep. 21, 2004. http://mlb.mlb.com/NASApp/mlb/mlb/news/mlb_press_release.jsp?ymd=20040921&content_id=865615&vkey=pr_mlb&fext=.jsp.*

* cited by examiner

*Primary Examiner* — Dmitry Suhol
*Assistant Examiner* — Kevin Y Kim
(74) *Attorney, Agent, or Firm* — Foley & Lardner LLP

(57) ABSTRACT

A system and method is described for determining a scoring efficiency of a team engaged in a sport, such as baseball, softball or other sport in which runners attempt to advance from a series of base positions. A memory or database stores a total number of runs scored from scoring position and a total number of individual base runners that reached base from a single at-bat, over a predetermined interval, such as an inning, a series of innings, a game or a series of games. A processor, coupled to the memory, determine scoring efficiency by determining a ratio between the number of runs scored from scoring position and the total number of individual base runners that reached base from a single at-bat. An output device operatively connected the processor receives the scoring efficiency calculated by the processor and transmits or displays the scoring efficiency for evaluation of a team's efficiency in scoring from scoring position or preventing scoring from scoring position. A team's offensive, defensive, or overall scoring efficiency can be determined.

6 Claims, 5 Drawing Sheets

60

SYSTEM AND METHOD FOR DETERMINING AN OFFENSIVE, DEFENSIVE, AND CUMULATIVE EFFICIENCY OF A SPORTS TEAM

FIELD OF THE INVENTION

The present invention relates generally to a system and method for determining an offensive, defensive, and cumulative efficiency of a sports team, such as a baseball or a softball team.

BACKGROUND OF THE INVENTION

A number of statistical parameters are known that attempt to capture the historic capability of sporting teams or individual players, either over a season, during an individual game, in particular innings, etc. For example, a winning percentage can be calculated for a team from the team's inception, during a season, against a specific opponent, etc. Batting averages and runs batted in (RBIs) can be calculated for teams or individual players. This information can extend over an entire career, for a season, during a game, against a specific pitcher, against an opposing team, etc.

Systems are known to utilize such statistics in various ways. Batting averages and winning percentages may be analyzed to evaluate a team's performance. They may also be used to add "color" to a broadcast commentary to a game. More recently, such statistics have been used in so-called "fantasy" sports leagues, and in simulation programs, in which specific instances of simulated performance may be based on historical performance measured as an average over a season or other interval.

However, no current statistical parameter effectively summarizes a team's efficiency using runners in scoring position, either as a current trend, over a season, or over a portion of a season, against a specific opposing team, etc. While runs batted in (RBIs) have long been used as a measure of scoring efficiency, RBIs alone do not take into account the position of a runner when the run is scored. Further, RBIs alone do not measure offensive efficiency of a hitter or a team, taking into account scoring opportunities. RBIs also do not measure a team's defensive capabilities in likely scoring situations.

What has been lacking, therefore, is a system and method that provides a statistically based efficiency value calculable for a team. What has also been lacking is a system and method that may includes consideration of a team's offensive efficiency and a team's defensive efficiency in an overall scoring efficiency value.

SUMMARY OF THE INVENTION

In accordance with one aspect of the invention, there is provided a system for determining a scoring efficiency of a team engaged in a sport in which runners attempt to advance from a series of base positions. The system includes a memory that stores first data representative of a total number of runs scored from scoring position over a predetermined interval and second data representative of a total number of individual base runners that reached base from a single at-bat over the predetermined interval. A processor, coupled to the memory, receives the first data and second data and determines scoring efficiency by determining a ratio between the number of runs scored from scoring position and the total number of individual base runners that reached base from a single at-bat. An output device operatively connects to the processor to receive the scoring efficiency calculated by the processor and transmits or displays the scoring efficiency for evaluation of a team's efficiency in scoring from scoring position or preventing scoring from scoring position.

In accordance with another aspect of the invention, a method of calculating a scoring efficiency of a team comprises receiving first data representative of a total number of runs scored from scoring position over a predetermined interval; receiving second data representative of a total number of individual base runners that reached base from a single at-bat over the predetermined interval; determining a ratio between the number of runs scored from scoring position and the total number of individual base runners that reached base from a single at-bat; and transmitting or displaying the scoring efficiency for evaluation of a team's efficiency in scoring from scoring position or preventing scoring from scoring position.

According to another aspect of the invention, there is a computer readable medium for storing code configured to execute the above-described method.

According to one feature of the invention, the predetermined interval is one of a season, a game, a series of innings, or a specific inning, or even a single plate appearance.

According to another feature of the invention, the scoring efficiency is an offensive scoring efficiency of a first team based on the total number of runs scored by the first team from scoring position over the predetermined interval and the total number of individual base runners from the first team that reached base from a single at-bat over the predetermined interval.

According to still another feature of the invention, the scoring efficiency is a defensive scoring efficiency of a team, based on the total number of runs scored by one or more opposing teams from scoring position over the predetermined interval and the total number of individual base runners from the one or more opposing teams that reached base from a single at-bat over the predetermined interval.

According to yet another feature of the invention, the scoring generates an overall scoring efficiency based on the difference between the offensive scoring efficiency and the defensive scoring efficiency.

Other principal features and advantages of the invention will become apparent to those skilled in the art upon review of the following drawings, the detailed description, and the appended claims.

BRIEF DESCRIPTION OF THE DRAWINGS

The preferred embodiments will hereafter be described with reference to the accompanying drawings, wherein like numerals will denote like elements.

DETAILED DESCRIPTION OF THE PREFERRED EMBODIMENTS

Figure 1:
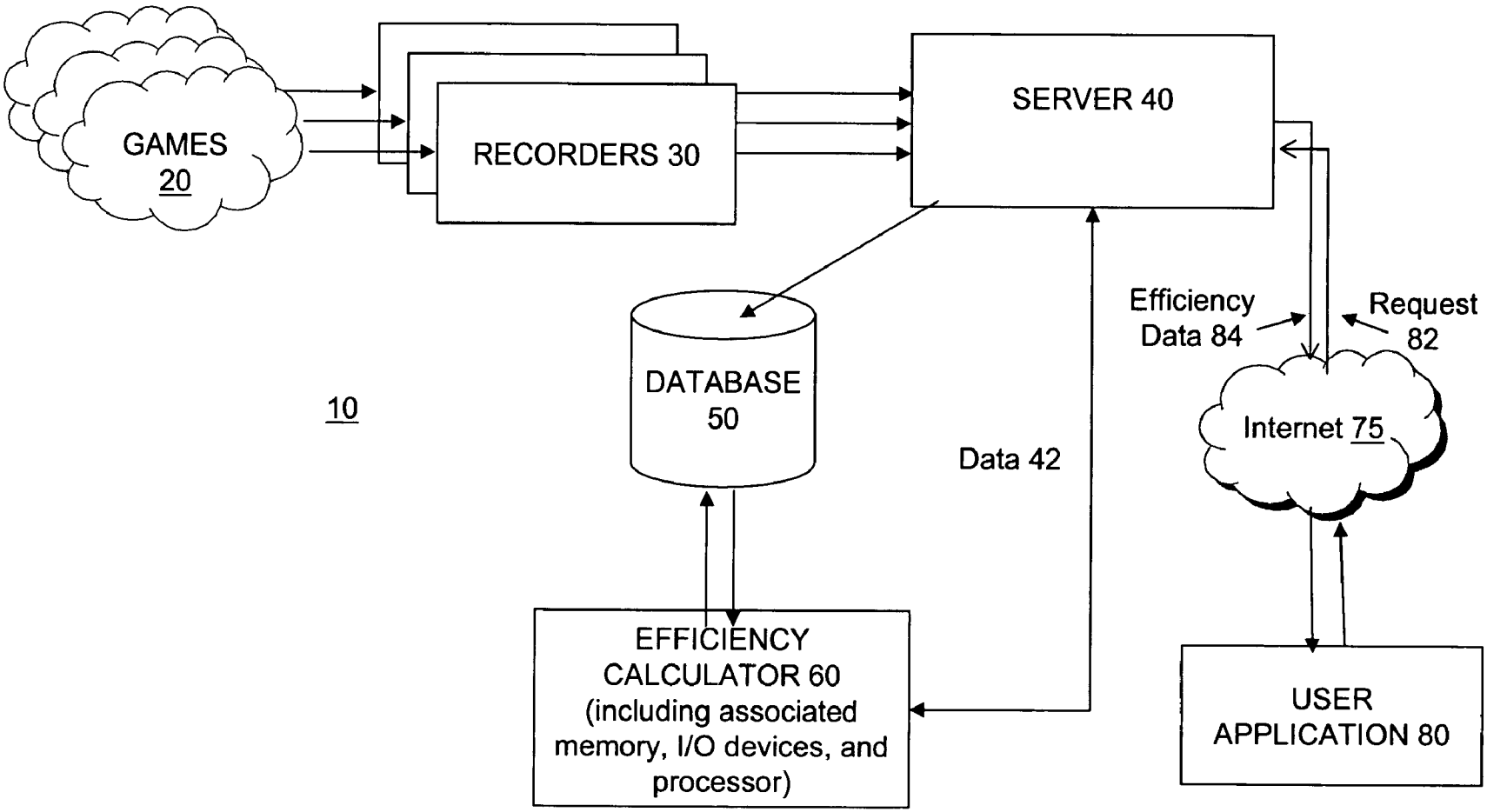
FIG. 1 is a block diagram of a system for recording data and determining scoring efficiency of teams participating in a set of games, according to an embodiment of the invention.

Aspects of the invention are first described in reference to FIG. 1, which is a block diagram of a system 10 according to a first exemplary embodiment of the invention. As discussed below, this system provides and supports a novel technique for calculating a team's offensive and defensive scoring efficiency. It should be appreciated, however, that the invention is not intended to be limited to this particular system, and various modifications to the illustrated system are available.

As shown, games 20 are observed and recorded with recorders 30. The games 20 may comprise baseball games, softball games, or other events in which a runner advances from established positions (e.g., bases) to a scoring position (e.g, home base). As well known in such games, runners positioned at certain bases, specifically second and third, are recognized to be in "scoring position." The present invention utilizes a novel technique to determine a team's offensive scoring efficiency when a runner is in scoring position, and conversely, to determine a team's defensive ability to prevent scoring from scoring position.

According to one technique, an observer observes the game and records symbolic representations of relevant events in the game, including the results associated with each at-bat (e.g., single, double, tripe, homerun, fielder's choice, etc.), each advancement of runners, each run scored, and each out. While data may be recorded by an observer and input manually, more preferably, however, relevant data for each game is recorded and transmitted electronically, as shown in FIG. 1.

By way of example and not limitation, data from games 20 may be generated and transmitted utilizing a customized application, operated by an observer watching a live or prerecorded game. The observer application records input from the observer representative of actions in a game, and generates output representing plays or events. This output may comprise a concise alphanumeric string in which particular combinations of symbols represent particular plays or events.

More specifically, each recorder 30 captures and records specific sub-events that characterize each game 20. The sub-events may be captured by an observer listening to or viewing the each game either at the game location or remote from the game location. The observer may capture the sub-events either during or at the completion of each game. Each sub-event may be identified using a predefined code that is based on the type of sub-event. Each sub-event may be recorded using the code that corresponds to the type of sub-event, thereby creating coded sub-event data that are associated with each game. Additionally, the individual performing the sub-event may be recorded with the sub-event code.

For example, sub-event types may include, but are not limited to, an at-bat, a hit, a base on balls, a strikeout, a single, a double, a triple, a home run, a run batted in, a run, an error, an earned run, etc. The sub-event codes that correspond to the sub-event types, for example, may be numerical or textual in format. The name of the baseball player performing the sub-event may be recorded with the sub-event code as the sub-event performer.

The plurality of recorders 30 may additionally record and capture timing data associated with the occurrence of each sub-event of a game. The timing of the sub-events may be captured and recorded by an observer listening to or viewing each game. The same or a different observer may capture the sub-event timing data and the coded sub-event data. The timing data for each sub-event may be measured relative to a number of different time references and in a variety of formats. The observer may capture the sub-event timing data either during or at the completion of the each game and store the timing data at the database 50.

The recorders 30 may include, but is not limited to, a computer of any form factor, which incorporates or operates together with a communication device as known in the art (such as a PC, a portable computer, a Blackberry™, a Personal Digital Assistant, a cellular telephone, a modem, etc.).

Data representing game events may be transmitted by the recorder 30 to the server 40 by a variety of techniques. According to one technique, data may be sent by way of messages that include a header, identifying a specific game, which then is received and recorded by the server and stored in the database 50, during or at the completion of each game 20. It will be appreciated that the coded data may be stored in memory prior to or instead of in the database 50. The coded sub-event data may be stored in a variety of formats as known to those skilled in the art. For example, the coded sub-event data may be recorded as a set of tables.

It will also be appreciated that while the recorders 30 interface with the database 50 using a network connection as shown in FIG. 1, they may also do so using various other technologies as known to those skilled in the art or to be developed. The server 40 may also interface with the database directly as shown or by various other techniques known or to be developed.

Further, the database 50 may utilize various database technologies as known to those skilled in the art including a simple file system and/or a system of tables and including database technologies to be developed. The database 50 also may use a variety of different architectural formats as known to those skilled in the art. The database 50 may include a single database or a plurality of databases.

Once relevant data for games of interest has been stored in database 50, it is accessed and processed by the efficiency calculator 60 to determine scoring efficiency and make the results available for various uses and applications. The efficiency calculator 60 may also interface with the database 50 according to various techniques known in the art. The efficiency calculator 60 processes relevant data to determine scoring efficiency relating to teams participating in the games 20 according to techniques described more particularly below.

The efficiency calculator 60 may include, for example, memory, a processor, and associated input/output devices as well known in the art. The components of the calculator 86 may each be internal or external to the device 86. The components may connect to each other using a number of different methods as known to those skilled in the art.

In the example shown in FIG. 1, the efficiency calculator 60 queries the database 50 for data relating to the number of runners in scoring position resulting from single at-bats and the number of runs scored by single at-bat runners in scoring position over a particular interval. The efficiency calculator 60 determines scoring efficiency (offensive, defensive, and/or overall efficiency) using these data. The efficiency calculator may then store the scoring efficiency information for later use and/or transmit it for use by other applications. In the example, shown, the efficiency calculator provides the scoring efficiency to the server 40, which formats the scoring efficiency for a particular team and makes it available for retrieval by other applications.

In the example, shown, a user application 80 makes a request 82 to the server 40, which in turn provides requested scoring efficiency data to the user application. Requests and resulting data may be communicated by various techniques known in the art. For example, requests may be transmitted by packetized data via the internet 75. Other techniques of communication, however, are possible. As discussed further below, scoring efficiency can be applied in a variety of applications.

Determination of scoring efficiency according to the invention is now described in greater detail in reference to FIGS.

2-4, which illustrate a technique for determining scoring efficiency in a single game or in a set of games.

In accordance with the invention, the efficiency calculator 60 performs calculations to determine a team's scoring efficiency, including a team's offensive scoring efficiency, a team's defensive scoring efficiency (based on opposing team's scoring), and team's overall scoring efficiency (based on both offensive scoring efficiency and defensive scoring efficiency).

Figure 2:
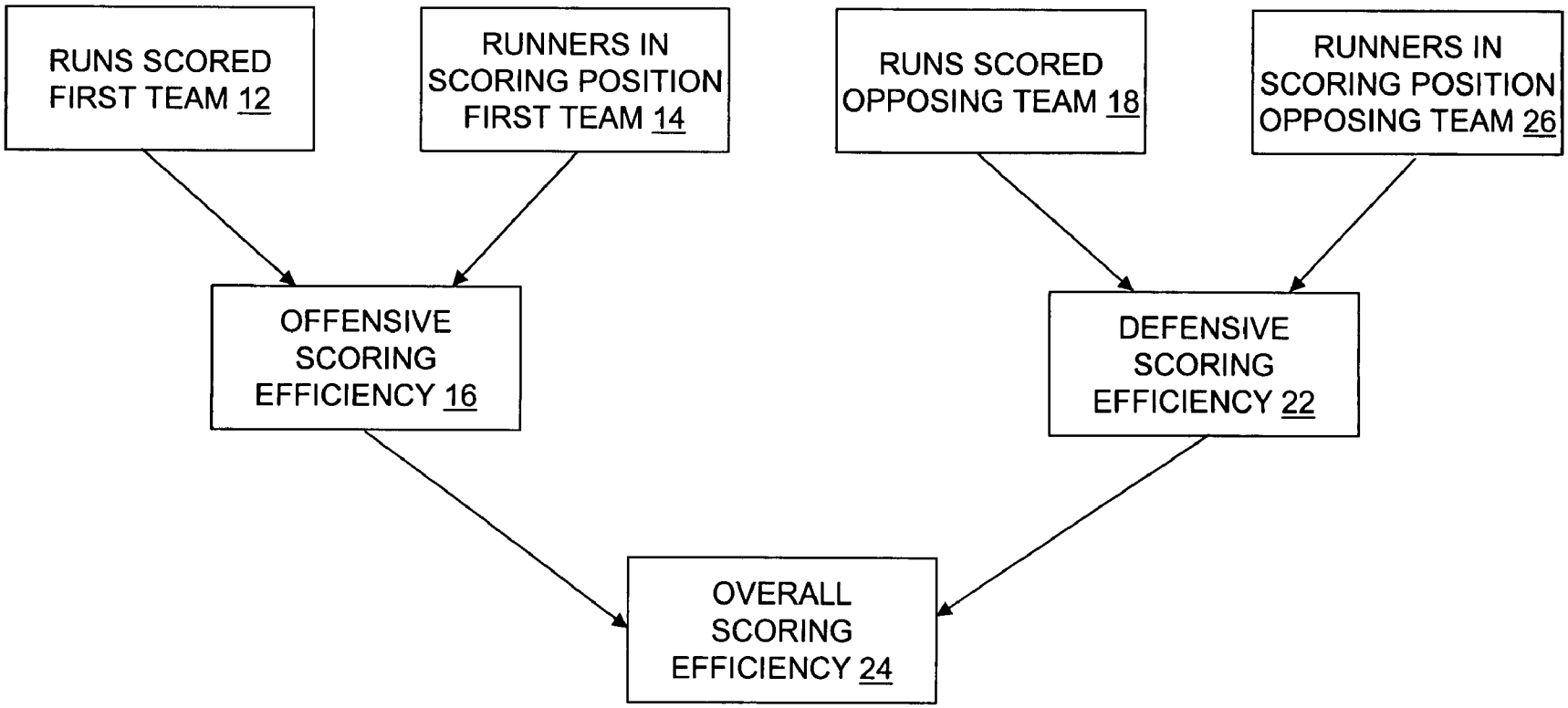
FIG. 2 is a block diagram illustrating determination of scoring efficiency in accordance with an embodiment of the invention.

With reference to the exemplary embodiment of FIG. 2, an overall scoring efficiency 24 is calculated to measure a team's efficiency at scoring its own runners that reach scoring position and at preventing the opponent's runners that reach scoring position from scoring. The overall scoring efficiency 24, preferably includes an offensive scoring efficiency 16 and a defensive scoring efficiency 22. The overall scoring efficiency 24 may be determined for a single game as shown with reference to FIG. 2 or for a plurality of games over various time periods as shown with reference to FIG. 3.

The present invention calculates scoring efficiency, a measure of the number of runs scored by runners in scoring position (e.g., runners in a baseball game that score from second or third base) and the total number of runners that reach scoring position as a result of a single at-bat (referred to as "single at-bat runners).

As noted above, in baseball, scoring position is reached when a runner reaches and stops at either second or third base for any subsequent player at-bat. Thus, for example, if a runner is on first base when the next player at-bat hits a triple or a home run, the runner on first scores, but is never considered to have reached scoring position. In comparison, if a player at-bat hits a triple, reaching and stopping at third base, that player is counted as a runner in scoring position. If a next player at-bat is thrown out at first base to make the third out of the inning, the runner at third base in scoring position does not score a run.

It is necessary to ensure that a runner reaching scoring position is not counted twice in determining scoring efficiency. For example, a runner that reaches second base on a double, and then advances to third base (for example, as a result of a steal, or a single, a sacrifice, or ground ball by the next player at-bat) is counted as a single at-bat runner, who reached scoring position, but only once.

As noted above, representations of games received from an observer may include messages that include player identifications. It is important, however, to ensure that a single at-bat runner is counted only once even though a player reaching scoring position may be substituted by another player. For example, a pinch runner may substitute for a player at second base to provide a faster runner. However, only a single runner should be counted as reaching scoring position, even though two different players physically reach scoring position. Thus, whether or not the same player reaches each base is not considered in determining scoring efficiency in accordance with the invention. In other words, the number of runners that reach scoring position should only include runners for a single at-bat.

Thus, a player that reaches second and then third on a subsequent player at-bat is counted only once because only a single scoring position is counted for the single at-bat by the runner. Similarly, the pinch runner and the hitting player are counted only once because only a single scoring position is counted for the single at-bat by the hitting player. Thus, single at-bat runners avoid a double counting of runners.

As illustrated in FIG. 1, offensive scoring efficiency 16 includes a number of runs scored from scoring position by a first team 12 and a number of single at-bat runners from the first team that reach scoring position 14 during the game. The number of runs scored from scoring position is a count of the runners that score on a play when the runner starts the at-bat of another hitter from either second base or third base.

For example, the offensive scoring efficiency 16 may be calculated as a ratio of the runs scored from scoring position by the first team 12 to the number of single at-bat runners from the first team that reach scoring position 14 during a game (or other interval). Of course, the runners need not score on a hit by the at-bat player. For example, a runner on third base may score on a wild pitch by the pitcher that is not fielded by the catcher.

Defensive scoring efficiency 22 of a team is similarly calculated as a ratio of the number of runs scored from scoring position by an opposing team 18 during a game (or other interval) and a number of single at-bat runners from the opposing team that reach scoring position 20 during the game (or other interval).

Based on offensive and defensive scoring efficiency, it is also possible to calculate overall scoring efficiency 24 in accordance with the invention. For example, overall scoring efficiency may be calculated as the difference between offensive scoring efficiency 16 and defensive scoring efficiency 22.

Figure 3:
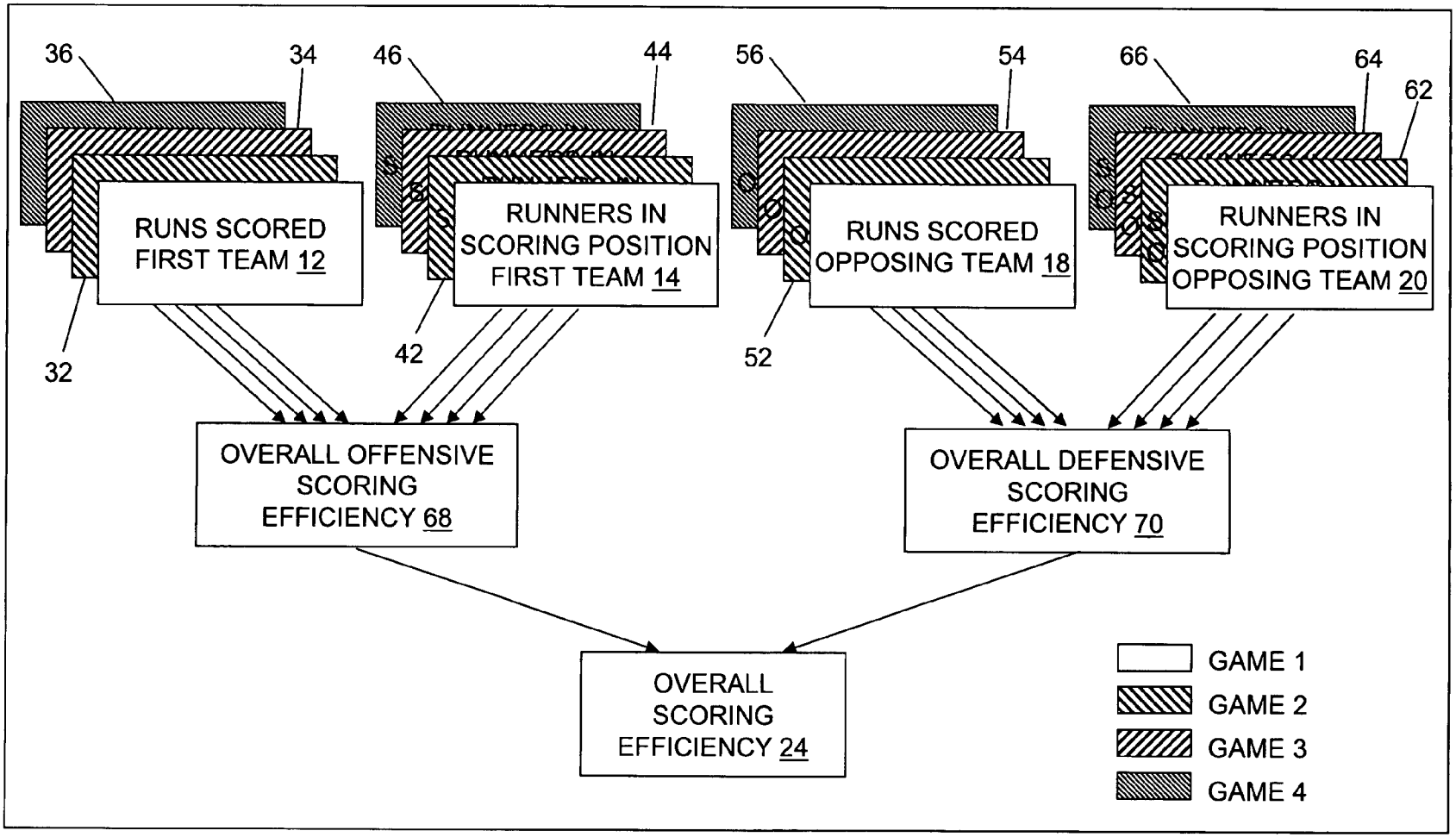
FIG. 3 is a block diagram illustrating determination of scoring efficiency in accordance with an alternative embodiment of the invention.

It will be appreciated that scoring efficiency may be calculated for not just a single game, but for a plurality of games as illustrated in FIG. 3. As shown, the overall scoring efficiency 24 in this example includes an overall offensive scoring efficiency 68 and an overall defensive scoring efficiency 70. The overall scoring efficiency 24 may be defined for a plurality of games against a specific opponent to determine the overall scoring efficiency 24 against that opponent during a series, during a season, etc.

The overall offensive scoring efficiency 68 may include a number of runs scored from scoring position by a first team 12 and a number of single at-bat runners from the first team that reach scoring position 14 during a game 1, a number of runs scored from scoring position by a first team 32 and a number of single at-bat runners from the first team that reach scoring position 42 during a game 2, a number of runs scored from scoring position by a first team 34 and a number of single at-bat runners from the first team that reach scoring position 44 during a game 3, and a number of runs scored from scoring position by a first team 36 and a number of single at-bat runners from the first team that reach scoring position 46 during a game 4. For example, the overall offensive scoring efficiency 68 can be calculated as the ratio of the runs scored from scoring position by the first team to the number of single at-bat runners from the first team that reach scoring position during the games 1, 2, 3, and 4. Thus, the ratio of runs scored from scoring position and the number of single at-bat runners is used to determine the overall offensive scoring efficiency 68.

The overall defensive scoring efficiency 70 may include a number of runs scored from scoring position by one or more opposing teams 18 the first team and a number of single at-bat runners from the opposing teams that reach scoring position 20 during the game 1, a number of runs scored from scoring position by opposing teams 52 of the first team and a number of single at-bat runners from the opposing team that reach scoring position 62 during the game 2, a number of runs scored from scoring position by opposing teams 54 and a number of single at-bat runners from opposing teams that reach scoring position 64 during the game 3, a number of runs scored from scoring position by opposing teams 56 and a number of single at-bat runners from opposing teams that reach scoring position 66 during the game 4. For example, the overall defensive scoring efficiency 70 may be calculated as the ratio of the runs scored from scoring position by opposing teams to the number of single at-bat runners from opposing teams that reach scoring position during the games 1, 2, 3, and 4. Thus, the runs scored from scoring position by opposing teams may be divided by the number of single at-bat runners from the opposing team that reach scoring position to calculate the overall offensive scoring efficiency 68. The overall scoring efficiency 24 may be the overall defensive scoring efficiency 70 subtracted from the overall offensive scoring efficiency 68. Again, the opposing team may or may not be the same team for each of games 1, 2, 3, and 4.

Figure 4:
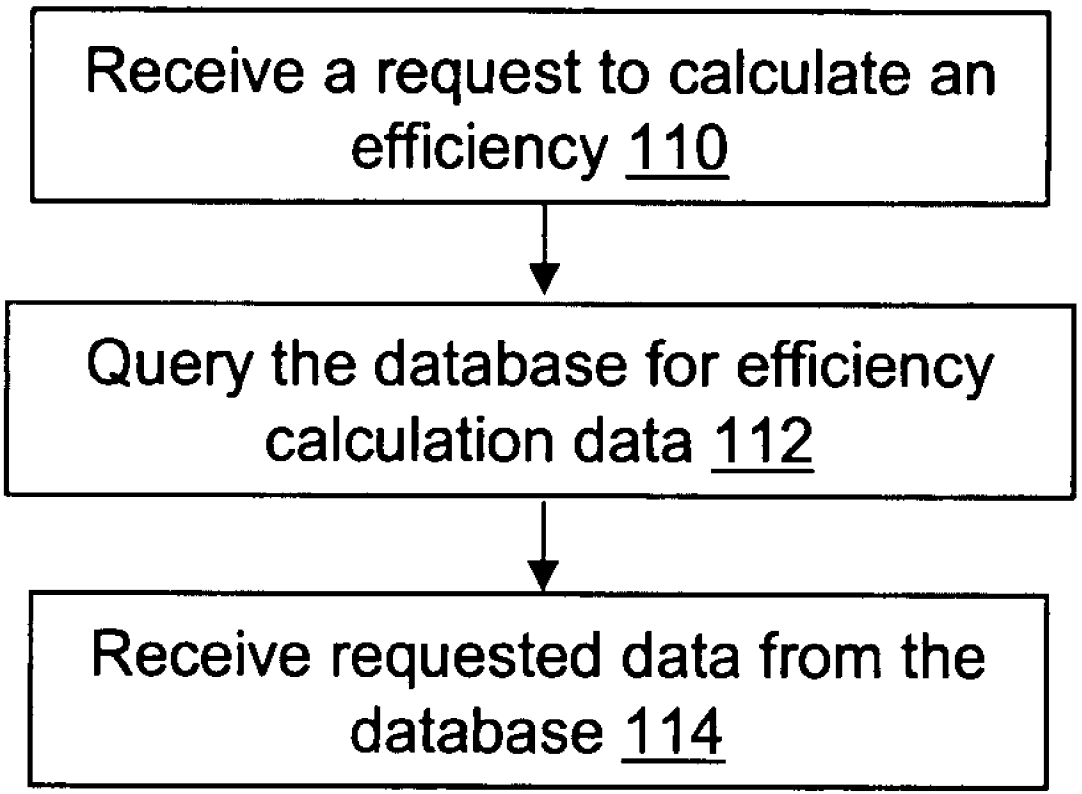
FIG. 4 is a flow diagram illustrating operations associated with an exemplary efficiency calculator according to the invention.

An exemplary operation of an efficiency calculator according to an embodiment of the invention is shown in FIG. 4. At an operation 110, the efficiency calculator receives a request to calculate a scoring efficiency for a team. For example, the scoring efficiency may be the offensive scoring efficiency 16, the defensive scoring efficiency 22, the overall scoring efficiency 24, the overall offensive scoring efficiency 68, and/or the overall defensive scoring efficiency 70 as discussed above.

At an operation 112, the efficiency calculator sends one or more queries to the database that includes the request for the scoring efficiency determination, for example a query to a database 50 as shown in FIG. 1. As known to those skilled in the art, a number of methods may be used to store and to access data in a database. Additionally, a single query may be used to determine the offensive scoring efficiency, the defensive scoring efficiency, the overall scoring efficiency, the overall offensive scoring efficiency, and/or the overall defensive scoring efficiency for one or more teams over a user specified time period. Alternatively, a plurality of queries, may be used to determine the offensive scoring efficiency, the defensive scoring efficiency, the overall scoring efficiency, the overall offensive scoring efficiency, and/or the overall defensive scoring efficiency for one or more teams over a user specified time period depending on the architecture of the database.

In response to the query 100, the database sends the requested data to the efficiency calculator. At an operation 114, the efficiency calculator receives the requested data from the database. The efficiency calculator 96 may be implemented in one or more programming language, scripting language, assembly language, etc. For example, the efficiency calculator 96 may be implemented as a set of SQL scripts that request the data 102 from the database 98. A user interface may allow a user to specify additional parameters such as the scoring efficiency parameter to calculate, the time frame, the teams, etc.

In the context of the foregoing discussion, it will be understood that a query is a request for information from a database. A query generally is formulated using a language designed to interface with the database. For example, the Structured Query Language (SQL) is one of the best known database query languages. The query may request the runs scored from scoring position and the single at-bat runners that reach scoring position for a set of conditions that may include, but is not limited to, a time period, a team name, an opposing team name, and/or a league. Thus, for example, the query may request a scoring efficiency for the set of teams in the American League during the month of September for the past five years. The actual query for determining the scoring efficiencies 16, 22, 24, 68, 70 may be specific to a database schema. Thus, the same raw data captured by the plurality of recorders 84 may produce the same result using different queries based on a different database architecture.

It will be appreciated that the scoring efficiency parameters may indicate a likelihood of success for a team. As such, these parameters may be utilized in various applications. For example, in reference to FIG. 1, a user may submit a request to a server 40 for the offensive scoring efficiency of a team, such as the New York Yankees in a particular game. The server then formulates a request that is processed by the efficiency calculator 60. For example, the efficiency calculator may formulate an SQL query to the database 60, which then provides data representative of the number of runs scored from scoring position by the Yankees in the requested game and data representative of the number of single at-bat runners by the Yankees that reached scoring position in the game. The efficiency calculator 60 calculates the difference and provides it to the server 40, which in turn, provides it to the user application 80. Similar calculations can be made for defensive scoring efficiency. Of course, it is possible to periodically calculate scoring efficiency for each of a set of teams and make that information available for download by users, for example, by way of the server 40. Users can then use the scoring efficiency parameter to evaluate a performance effectiveness of a baseball team for a variety of purposes. For example, it may be used for team scouting. It could be used by a team manager to assess performance. It could also be used by other services that format and provide sports statistics. It could be used by sports commentators and writers. It could also be used by a fantasy league baseball participant in determining from which teams to select players.

Other applications of the invention will also be apparent. For example, it is known to apply statistical performance data, such as RBI or batting average to provide simulations, such as simulated baseball games. In an alternative embodiment, a user could obtain scoring efficiency from an efficiency calculator and use the scoring efficiency as part of a simulation. For example, the scoring efficiency could be applied as a weighted factor for a random generator to simulate the performance of a team at-bat with runners in scoring position. Similarly, defensive scoring efficiency could be used for simulated performance of team.

In the example shown in FIG. 1, scoring efficiency can be derived from standard representations of games provided by the recorders. It will be appreciated, however, that it is possible for the recorders to be programmed to select and flag single at-bat runners and runs scored by runners in scoring position and provide these data, directly or indirectly to a processor, which is either integral to or separate from the recorder.

Further, it should be appreciated that the invention can be used to process data representative of single at-bat runners and data representative of runs scored from scoring position, which are obtained at selected intervals from a live event (for example, at the end of each at-bat, at the end of an inning, or at the end of the game). Such data can also be derived from historical sources, including recording of past events or prior recorded data representative of at-bats and runner movement.

Those skilled in the art will recognize that the system and methods of the present invention may be advantageously operated and implemented in a variety of ways. In accordance with one embodiment, a method according to the invention may be provided in the form of code on a machine readable medium or media.

Further, the invention may be practiced in conjunction with a variety of systems, and may utilize a variety of hardware and software platforms.

Figure 5:
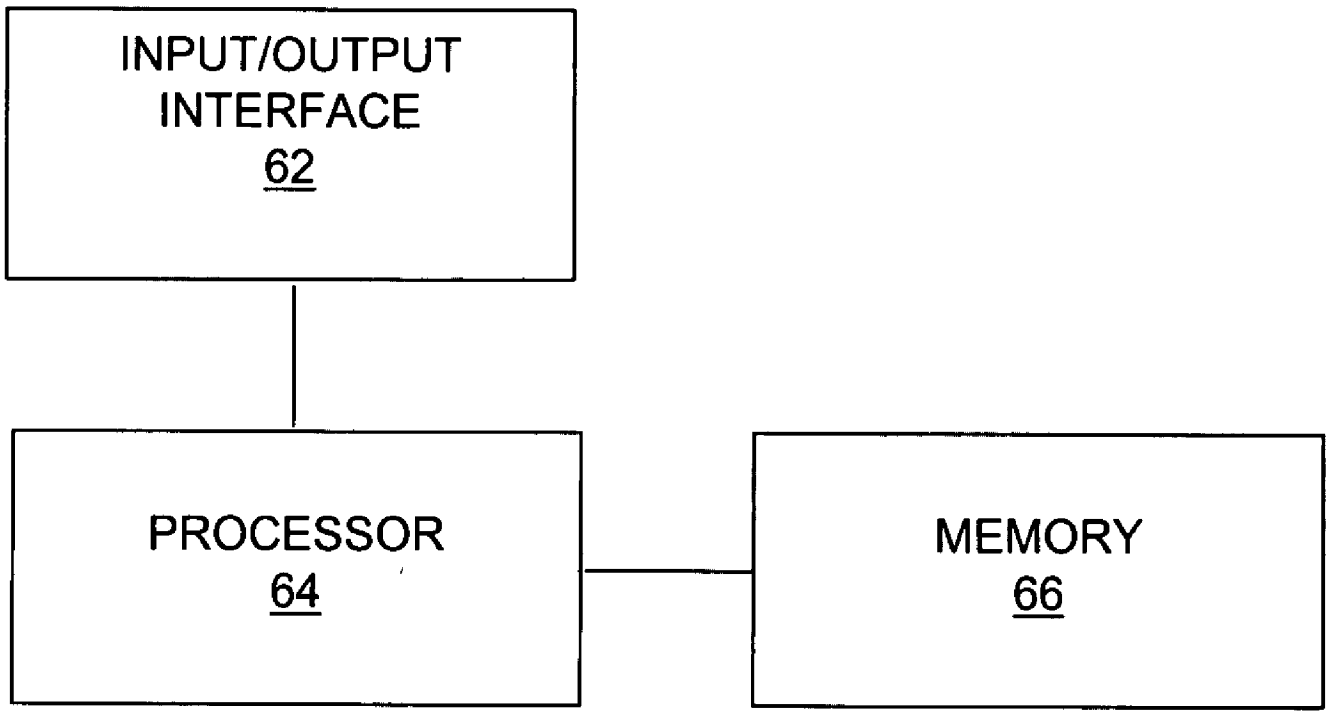
FIG. 5 is a block diagram illustrating components of an efficiency calculator according to an embodiment of the invention.

For example, in one embodiment, shown in FIG. 5, the scoring efficiency calculator may comprise an input/output (I/O) interface 62 coupled with a processor 64 and memory 66. The I/O interface may comprise a single device or a several discrete devices, each coupling with the database and/or with a user requesting scoring efficiency information.

Accordingly, it will be appreciated that the input interface 60 may use various input technologies including, but not limited to, a keyboard, a pen and touch screen, a mouse, a track ball, a touch screen, a keypad, one or more buttons, etc. to allow the user to enter information or to make selections. The input interface may also include, for example, a touch screen display that allows a user to make selections and presents information to the user.

The memory 66 may serve to provide an electronic holding place for an operating system for the efficiency calculator 96 and/or other applications. The device 66 may include a plurality of memory devices that use the same or different memory technologies. Exemplary memory technologies include, but are not limited to, Random Access Memory (RAM), Read Only Memory (ROM), flash memory, etc. A variety of different storage media may be used for each memory technology. For example, a Compact Disk (CD), a Digital Video Disk (DVD), and a hard disk are all ROM storage media types.

The processor 64 executes instructions that cause the efficiency calculator to perform various functions, including those described herein. The instructions may be written using one or more programming language, scripting language, assembly language, etc. Additionally, the instructions may be carried out by a special purpose computer, logic circuit, or hardware circuit. Thus, the processor may be implemented in hardware, firmware, software, or any combination of these methods.

The term "execution" refers to the process of running an application or program or the carrying out of the operation called for by an instruction. The processor 64 executes an application meaning that it performs the operations called for by that application in the form of a series of instructions. The processor 64 may retrieve an application from a non-volatile memory that is generally some form of ROM or flash memory and may copy the instructions in an executable form to a temporary memory that is generally some form of RAM. The processor 64 may execute instructions embodied in the efficiency calculator 96. The device 86 may include one or more processor 94.

The invention may be implemented using different operating systems including, but not limited to, the Microsoft® Windows™ operating system, the Macintosh® operating system, the LINUX operating system, or UNIX® based operating systems. Additionally, the functionality described may be distributed among modules that differ in number and distribution of functionality from those described herein without deviating from the spirit of the invention. Additionally, the order of execution may be changed without deviating from the spirit of the invention.

It should be understood that the invention is not confined to the particular embodiments set forth herein as illustrative, but embraces all such modifications, combinations, and permutations as come within the scope of the following claims. Thus, the description of the preferred embodiments is for purposes of illustration and not limitation.

What is claimed is:

1. A system comprising:

a recorder device configured to monitor games and record data corresponding to events that occur during the games, wherein the events include at least runs scored from scoring position and individual base runners that reach scoring position from a single at-bat;

a server operatively coupled to the recorder device and configured to receive the recorded data from the recorder device, wherein the server is further configured to receive a request from a user for a scoring efficiency for a team over a specific interval of time, wherein the specific interval of time is identified in the request;

a memory operatively coupled to the server and configured to receive the recorded data from the server and to store the recorded data; and a processor operatively coupled to at least the memory and the server and configured to:

receive the request from the server;

determine, based on the recorded data stored in the memory, first data representative of a total number of runs scored from scoring position by the team over the specific interval of time and second data representative of a total number of individual base runners from the team that reached scoring position from a single at bat over the specific interval of time; and determine the scoring efficiency of the team over the specific interval of time by determining a ratio of the first data to the second data;

wherein the server is further configured to receive the scoring efficiency from the processor and to provide the scoring efficiency to the user in response to the request.

2. The system of claim 1, wherein the specific interval of time is one of a season, a game, a series of innings, or a specific inning.

3. The system of claim 1, wherein the scoring efficiency is an offensive scoring efficiency of the team based on the total number of runs scored by the team from scoring position over the specific interval of time and the total number of individual base runners from the team that reached scoring position from a single at-bat over the specific interval of time.

4. The system of claim 1, wherein the scoring efficiency is a defensive scoring efficiency of the team, based on the total number of runs scored by one or more opposing teams from scoring position over the specific interval of time and the total number of individual base runners from the one or more opposing teams that reached scoring position from a single at-bat over the specific interval of time.

5. The system of claim 1, wherein the scoring efficiency is one or more of an offensive scoring efficiency of a first team based on the total number of runs scored by the first team from scoring position over the specific interval of time and the total number of individual base runners from the first team that reached scoring position from a single at-bat over the specific interval of time, a defensive scoring efficiency of the first team, based on the total number of runs scored by one or more opposing teams from scoring position over the specific interval of time and the total number of individual base runners from the one or more opposing teams that reached scoring position from a single at-bat over the specific interval of time, or an overall scoring efficiency based on the difference between the offensive scoring efficiency and the defensive scoring efficiency.

6. The system of claim 1, wherein the memory comprises a database.

* * * * *

UNITED STATES PATENT AND TRADEMARK OFFICE

CERTIFICATE OF CORRECTION

PATENT NO. : 8,121,712 B2
APPLICATION NO. : 10/979799
DATED : February 21, 2012
INVENTOR(S) : Bowman et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 732 days.

Signed and Sealed this
Seventeenth Day of April, 2012

David J. Kappos

David J. Kappos
*Director of the United States Patent and Trademark Office*